US008545300B2

(12) United States Patent
Colton

(10) Patent No.: US 8,545,300 B2
(45) Date of Patent: Oct. 1, 2013

(54) SYSTEM AND METHOD OF TRACKING AND DISPLAYING OUTCOMES OF A LIVE CRAPS GAME

(76) Inventor: Roland C. Colton, Laguna Niguel, CA (US)

( * ) Notice: Subject to any disclaimer, the term of this patent is extended or adjusted under 35 U.S.C. 154(b) by 1465 days.

(21) Appl. No.: 11/683,878

(22) Filed: Mar. 8, 2007

(65) Prior Publication Data

US 2008/0217851 A1 Sep. 11, 2008

(51) Int. Cl.
*A63F 9/24* (2006.01)

(52) U.S. Cl.
USPC ..... 463/10; 453/42; 273/309

(58) Field of Classification Search
None
See application file for complete search history.

(56) References Cited

U.S. PATENT DOCUMENTS

| | | | | | |
|---|---|---|---|---|---|
| 4,339,798 | A | * | 7/1982 | Hedges et al. | 463/26 |
| 4,531,187 | A | * | 7/1985 | Uhland | 463/12 |
| 4,764,666 | A | * | 8/1988 | Bergeron | 463/25 |
| 5,127,651 | A | * | 7/1992 | Okada | 273/143 R |
| 5,429,361 | A | * | 7/1995 | Raven et al. | 463/25 |
| 5,487,547 | A | * | 1/1996 | Hobert | 273/274 |
| 5,490,670 | A | * | 2/1996 | Hobert | 273/274 |
| 5,651,548 | A | * | 7/1997 | French et al. | 463/25 |
| 5,702,303 | A | * | 12/1997 | Takemoto et al. | 463/27 |
| 5,735,742 | A | * | 4/1998 | French | 463/25 |
| 5,770,533 | A | * | 6/1998 | Franchi | 463/42 |
| 5,788,240 | A | * | 8/1998 | Feinberg | 273/274 |
| 5,829,748 | A | * | 11/1998 | Moore, Jr. | 273/274 |
| 5,829,749 | A | * | 11/1998 | Hobert | 273/274 |
| 5,839,960 | A | * | 11/1998 | Parra et al. | 463/41 |
| 5,934,676 | A | | 8/1999 | Rubin | |
| 5,964,463 | A | * | 10/1999 | Moore, Jr. | 273/274 |
| 6,039,648 | A | * | 3/2000 | Guinn et al. | 463/16 |
| 6,123,335 | A | | 9/2000 | Adkins | |
| 6,213,876 | B1 | * | 4/2001 | Moore, Jr. | 463/22 |
| 6,364,314 | B1 | | 4/2002 | Canterbury | |
| 6,508,709 | B1 | * | 1/2003 | Karmarkar | 463/42 |
| 6,659,866 | B2 | * | 12/2003 | Frost et al. | 463/17 |
| D485,583 | S | | 1/2004 | Porto | |
| D501,230 | S | | 1/2005 | Stasi | |
| 2001/0035604 | A1 | | 11/2001 | Jones | |
| 2003/0232651 | A1 | * | 12/2003 | Huard et al. | 463/42 |
| 2006/0043678 | A1 | | 3/2006 | Golden | |
| 2006/0084502 | A1 | | 4/2006 | Downs, III et al. | |
| 2006/0186597 | A1 | | 8/2006 | Silverman | |
| 2006/0287058 | A1 | | 12/2006 | Resnick et al. | |

FOREIGN PATENT DOCUMENTS

| | | | |
|---|---|---|---|
| CA | 2344064 | | 3/2000 |
| WO | WO96/14115 | * | 5/1996 |

* cited by examiner

*Primary Examiner* — Paul A D'Agostino
(74) *Attorney, Agent, or Firm* — Greenberg Traurig

(57) ABSTRACT

A system and method for recording and displaying craps game data is disclosed. A display positioned proximate to a craps table displays craps game data which can be manually input or acquired automatically. Manually inputting craps game data is facilitated by a remote control device in communication with the display. A scanner, camera or other image capturing means can be used to acquire dice roll outcomes which are then automatically transmitted to the display. Various displayed craps game data, including a roll history and a clock, allow players to observe whether a craps table is hot or cold. System memory permits best rolls of the day, week, month, year or all time to be displayed as well.

41 Claims, 11 Drawing Sheets

SYSTEM AND METHOD OF TRACKING AND DISPLAYING OUTCOMES OF A LIVE CRAPS GAME

FIELD OF THE INVENTION

The embodiments of the present invention relate to a system for tracking game outcomes of a live craps game wherein said system includes an electronic display for displaying game outcomes associated with the live craps game as well as the time associated with each player's roll.

BACKGROUND

Casinos are a mix of electronic gaming machines (e.g., slot machines) and live casino games (e.g., craps). Over the past ten years or so, electronic gaming machines have encroached on the floor space allocated to live casino games. The reasons for the increased popularity of the electronic gaming machines are many, including ease of tracking play, low overhead costs and profitability. However, many gamblers do not enjoy the solitude and "pure luck" associated with electronic gaming machines. Therefore, live games of chance are always a good compliment to the electronic gaming devices. One such live game of chance is craps.

Craps is a dice game predicated on the sum of two rolled dice. Craps is one of the most exciting live casino games found on a casino floor. It is not uncommon to hear yelling and shouting at a craps table. The craps table can accommodate up to about 20 players, who are each given the opportunity to throw or shoot the dice. If a player does not want to throw the dice, they are passed to next player in a clockwise fashion. Several types of bets can be made on the craps table layout. Craps table personnel consists of a stickman, boxman and two dealers. The first roll of the dice in a betting round is called the come out roll—a new game in craps begins with the come out roll. On a come out roll, a 7 or 11 is a pass line winner; 2, 3 or 12 are pass line losers and 4, 5, 6, 8, 9 and 10 are points. A come out roll is a first roll at a newly opened table, made after a shooter fails to establish a point or once a player rolls a 7 after establishing a point and before re-rolling the point. If the current shooter does make his point, the dice are returned to him and he then begins a new game with a new come out roll. This is a continuation of that shooter's roll, although technically, the come out roll begins a new craps game. When the shooter fails to make his or her point, the dice are then offered to the next player for a new come out roll and a new game begins. The dice are rolled across the craps table layout. The layout is divided into three areas—two side areas separated by a center one. Each side area is the mirror reflection of the other and contains the following: Pass and Don't Pass line bets, Come and Don't Come bets, Odds bet, Place bets and Field bets. The center area is shared by both side areas and contains the Proposition bets.

The excitement of a craps game builds as a player continues to roll the dice after establishing a point. Therefore, the yelling and shouting become more apparent as the player continues to roll the dice. This is because players stand to make more money the longer the shooter holds the dice. For example, players tend to place bets on many numbers and increase the bets as the shooter continues to roll the dice successfully. Indeed, players at a craps table shower praise and encourage good shooters. In other words, the environment, in most instances, pits the commonly aligned players against the casino.

Unfortunately, other than analyzing the yelling and the shouting, there is no way of knowing how well a shooter is doing during his or her roll. That is, players often tell stories of the shooter who held the dice 45 minutes or the shooter who hit 15 points. While the stories may be true, few know for certain.

Therefore, it would be advantageous to provide a system of tracking craps game outcomes including an electronic display in proximity to a craps table such that roll outcomes may be displayed. Also, the display should be able to track and display any desired game data such as an amount of time dice are held by as a shooter.

SUMMARY

Accordingly, a first embodiment of the present invention is a craps system comprising: a display; means for personnel overseeing a live craps game to input craps game data; and transmission means for transmitting said input game data to said display. A second embodiment is a craps system comprising: a display; means for automatically acquiring craps game data; and transmission means for transmitting said acquired game data to said display.

A first method embodiment of the present invention comprises: inputting craps game data; transmitting said input game data to a display; and utilizing said transmitted game data to generate a display output. A second method comprises: acquiring automatically craps game data; transmitting said acquired game data to a display; and utilizing said transmitted game data to generate a display output.

The embodiments of the present invention provide a visual record of each player's roll while it happens. In addition, a clock on the display tracks an amount of time associated with the current player's roll. Depicting craps game data on an electronic display in a casino allows potential players and other gamblers the ability to determine if the table is "hot" or "cold." A "hot" table tends to attract players which ultimately benefits the casino.

Other variations, embodiments and features of the present invention will become evident from the following detailed description, drawings and claims.

DETAILED DESCRIPTION

Figure 1:
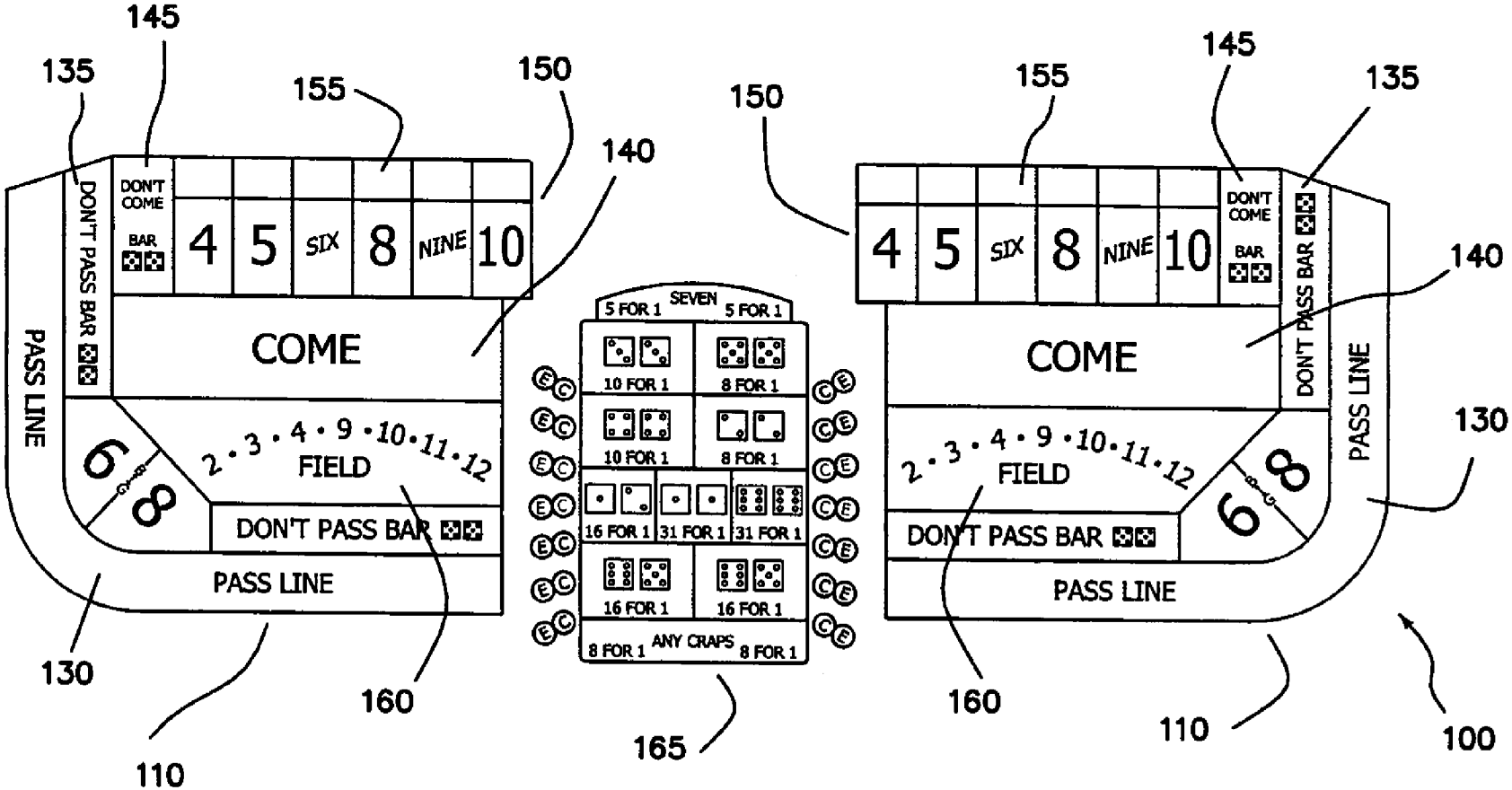
FIG. 1 illustrates a craps layout.

For the purpose of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

The game of craps is well-known in the gaming industry and therefore the precise rules of the game need not be detailed herein. Nonetheless, as needed, certain craps rules will be relied upon to explain certain features of the embodiments of the present invention. FIG. 1 illustrates a conventional craps layout 100. The layout 100 is divided into three areas comprising two side areas 110 separated by a center area 120. Each side area 110 is the mirror reflection of the other and contains the following areas: Pass Line 130 and Don't Pass Line 135 bets, Come 140 and Don't Come 145 bets, Odds' 150 bets, Place bets 155 and Field 160 bets. The center area contains the Proposition 165 bets.

Figure 10A:
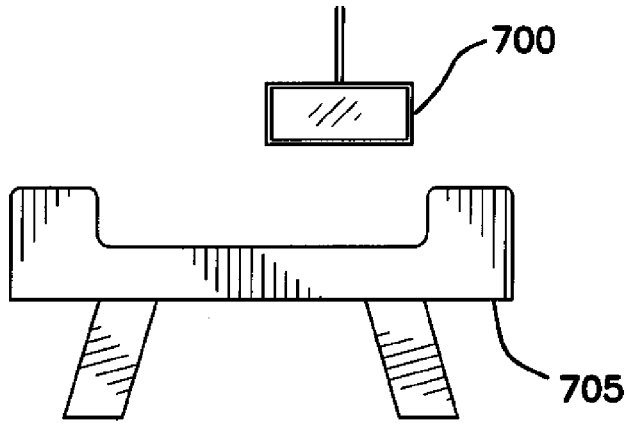
FIGS. 10*a*-10*d* illustrate views of a craps display in proximity to, or integrated in, a craps table.
Figure 10B:
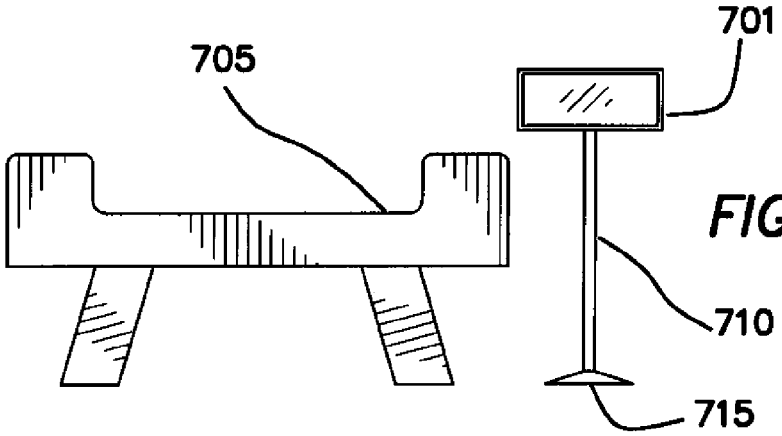

Now referring to FIGS. 2-7, various exemplary display screens are shown. The corresponding displays may incorporate LCD, LED, plasma, high-definition or related technologies. During downtime, the displays may be used to present content stored on DVDs or servers, or content transmitted via satellite, cable or television signals. In one embodiment, the displays are two-sided for maximum viewing by casino patrons. As shown in FIGS. 10*a* and 10*b*, the display may be positioned to hang above the craps table or it may be positioned adjacent to the craps table on a rigid support. The display may be positioned in any number of locations, including attachment to the craps table (FIG. 10*c*), by any number of support means, or within the craps table (FIG. 10*d*), as long as it permits patrons to easily view the content displayed thereon.

Figure 2:
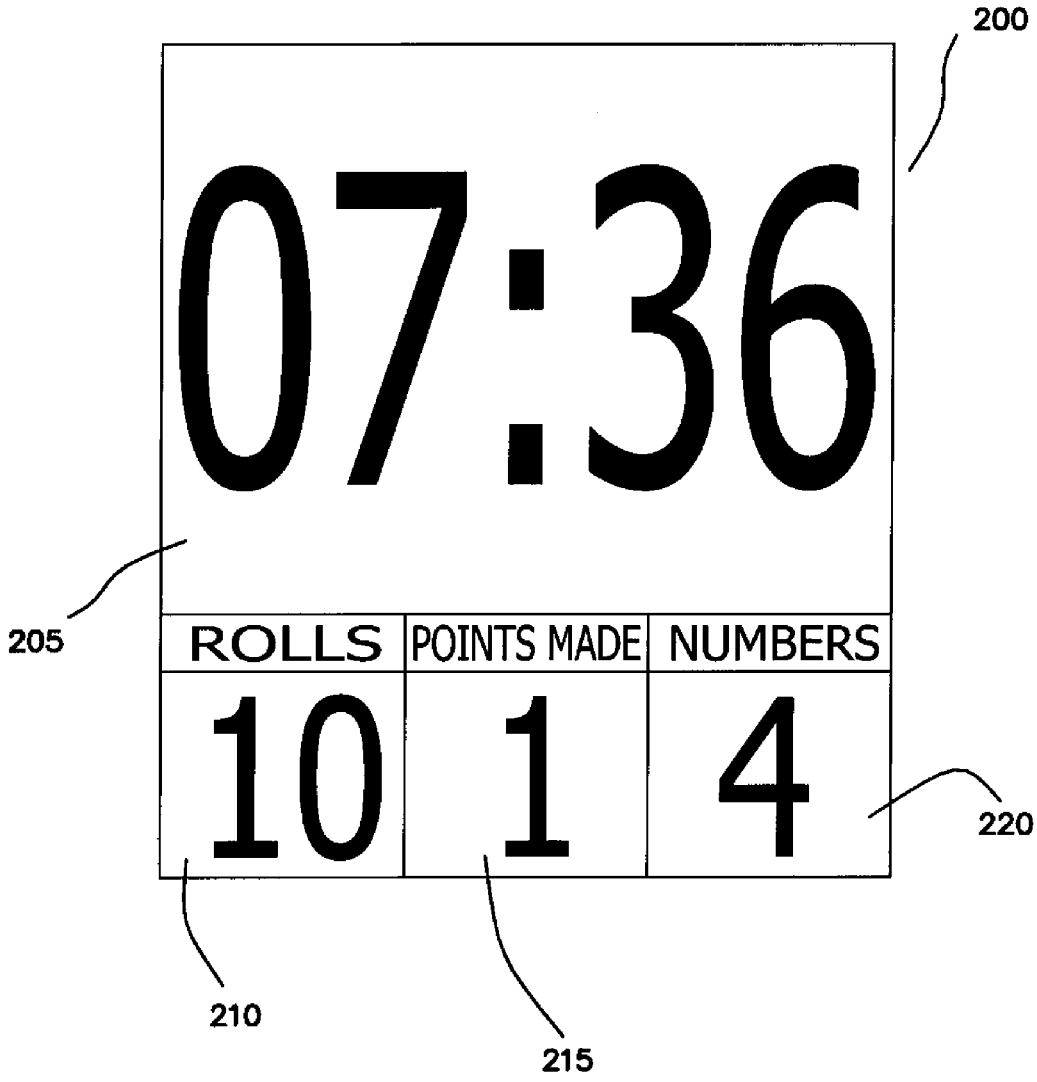
FIG. 2 illustrates a first exemplary craps display screen.

FIG. 2 shows a basic display screen 200 having sections corresponding to a clock 205, number of rolls 210, points 215 and numbers 220. In this instance, the clock 205 shows that the player (shooter) has held the dice for a total of 7:36, has rolled the dice 10 times, made 1 point and rolled 4 numbers. As described below, the information depicted on the display screen can be controlled by casino personnel managing the craps game or automatically controlled by an integrated electronic system.

Figure 3:
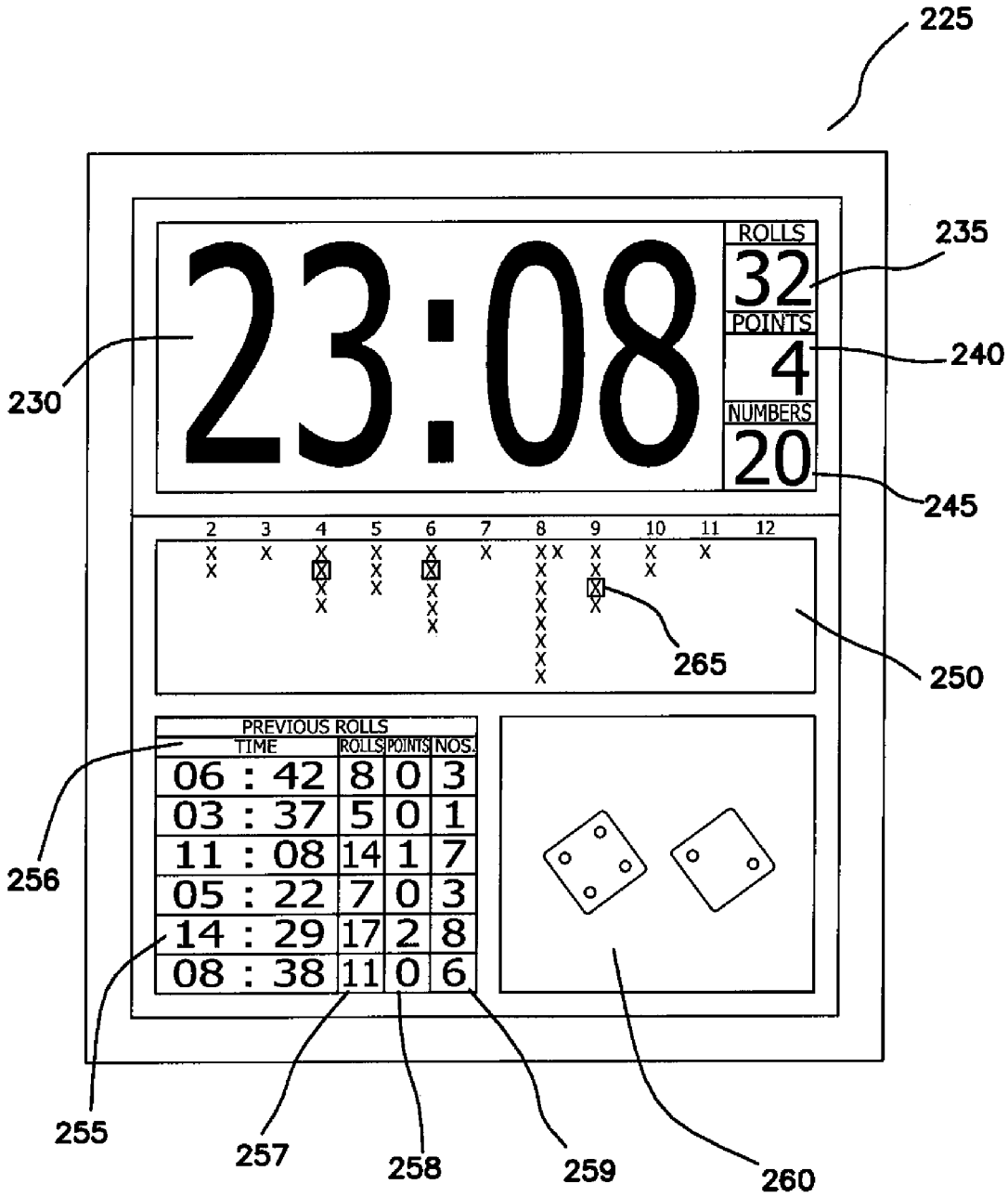
FIG. 3 illustrates a second exemplary craps display screen.
Figure 4:
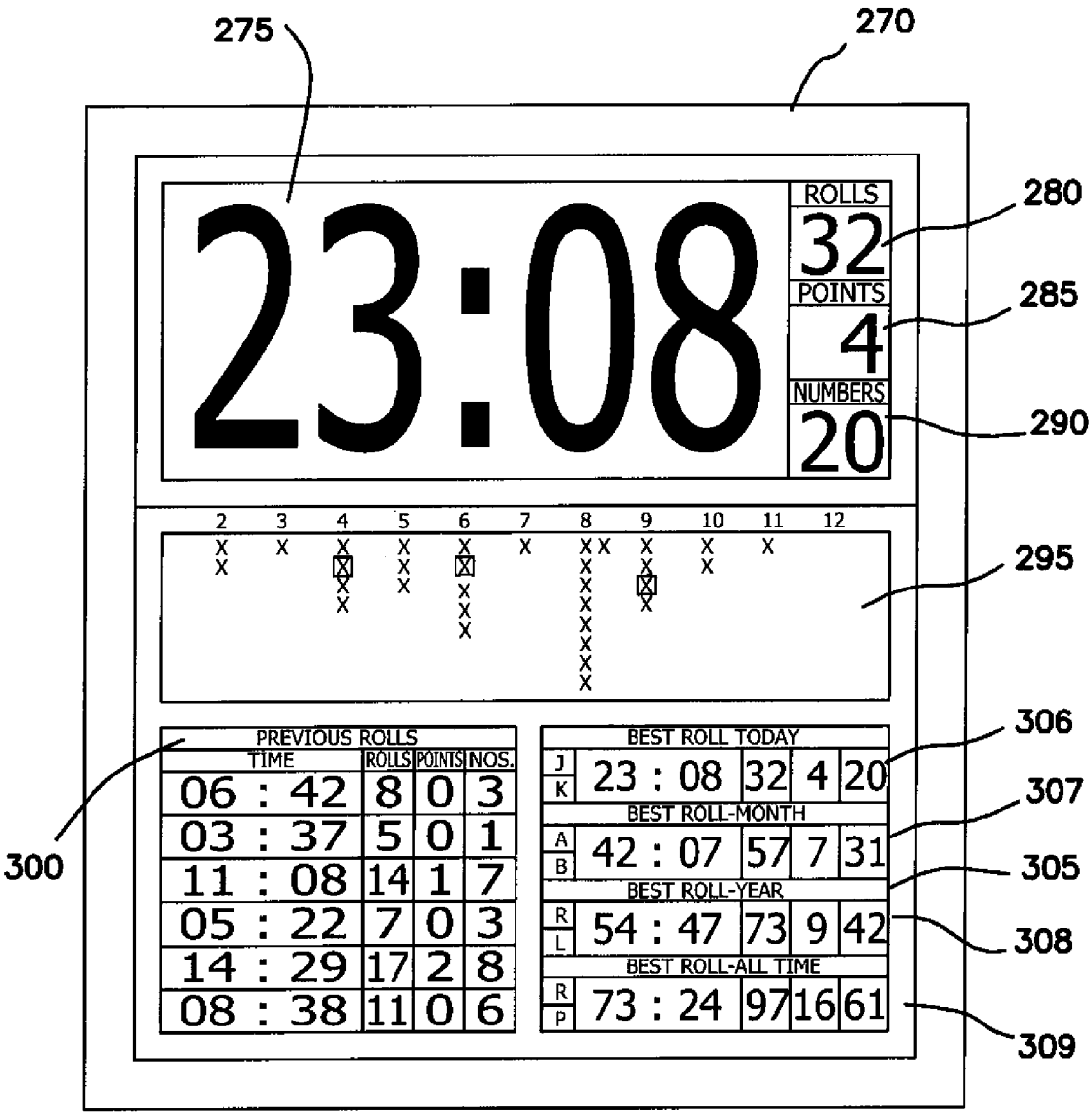
FIG. 4 illustrates a third exemplary craps display screen.

FIG. 3 shows a more comprehensive display screen 225 having sections corresponding to a clock 230, number of rolls 235, points made 240, numbers rolled 245, chart of numbers rolled 250, history of prior rolls 255 and a simulated pair of dice corresponding to an outcome of the previous roll 260 for the current shooter. The chart of numbers rolled 250 identifies each roll outcome during the streak and further identifies those rolls 265 which correspond to points made. The roll outcome can be displayed by an "x" as noted 265, or the roll outcome can be displayed numerically (e.g., display can show that 2"4s" had been rolled, 5"6s" had been rolled, etc.). The identification of points can be made via bolding of the outcomes, varying the color, circling the outcome or otherwise differentiating non-point roll outcomes from made point roll outcomes. The identification of hardway numbers or hardway points (i.e., 3+3) can also be made in a manner that differentiates it from non-hardway numbers or non-hardway points by varying the color, circling the outcome, bolding the outcome, or otherwise differentiating them from the other non-hardway numbers or non-hardway points. The prior roll history 255 shows the results, including time rolled 256, number of rolls 257, points made 258 and numbers rolled 259, from the prior six shooters. FIG. 4 shows a display screen 270 having sections corresponding to a clock 275, number of rolls 280, points 285, numbers rolled 290, chart of numbers rolled 295, history of prior rolls 300 and a history 305 of record rolls, based on the time the shooter held the dice, of the day 306, month 307, year 308 and all time 309. Initials 310 of the shooter responsible for each best roll record are listed adjacent to the corresponding best roll record.

Figure 5:
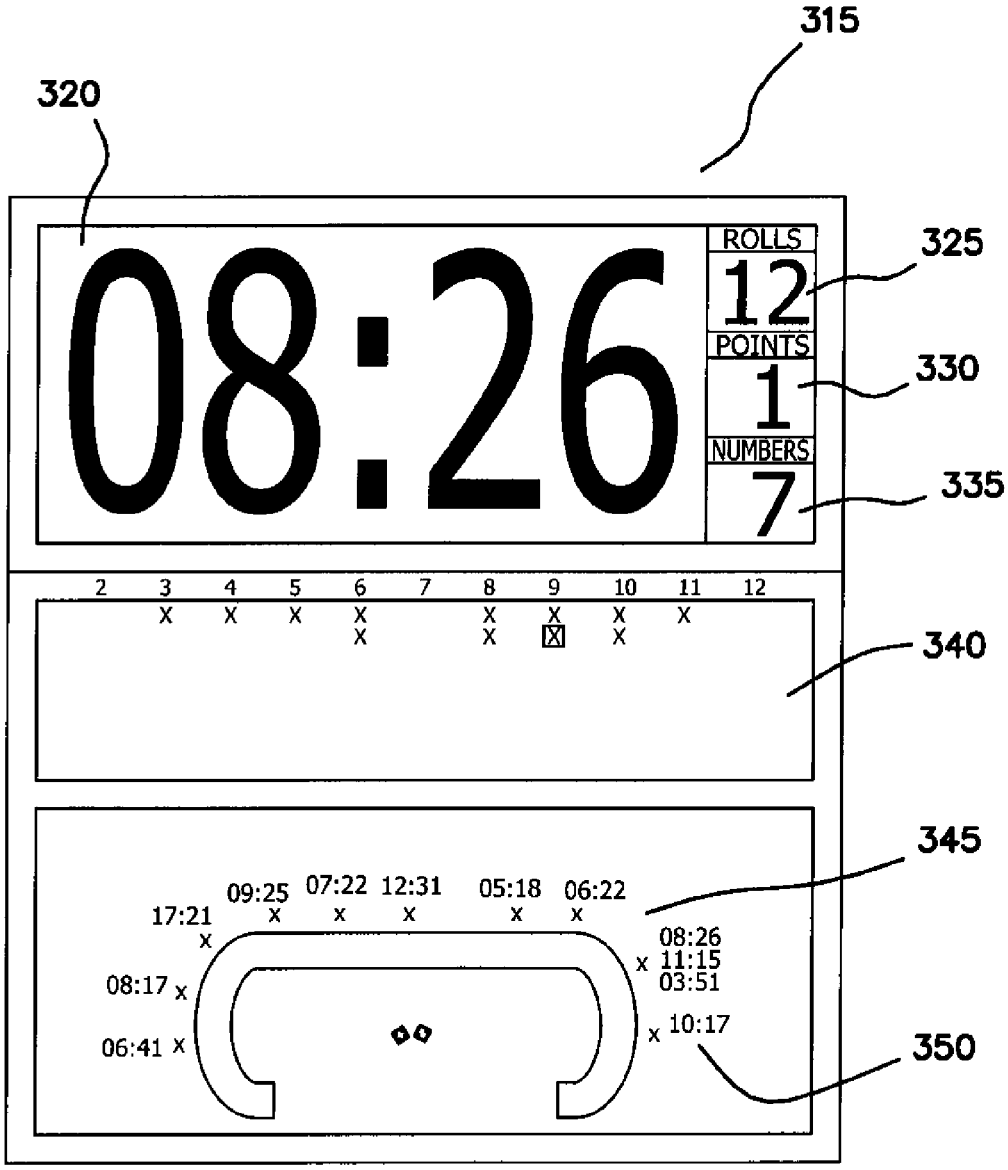
FIG. 5 illustrates a fourth exemplary craps display screen.
Figure 6:
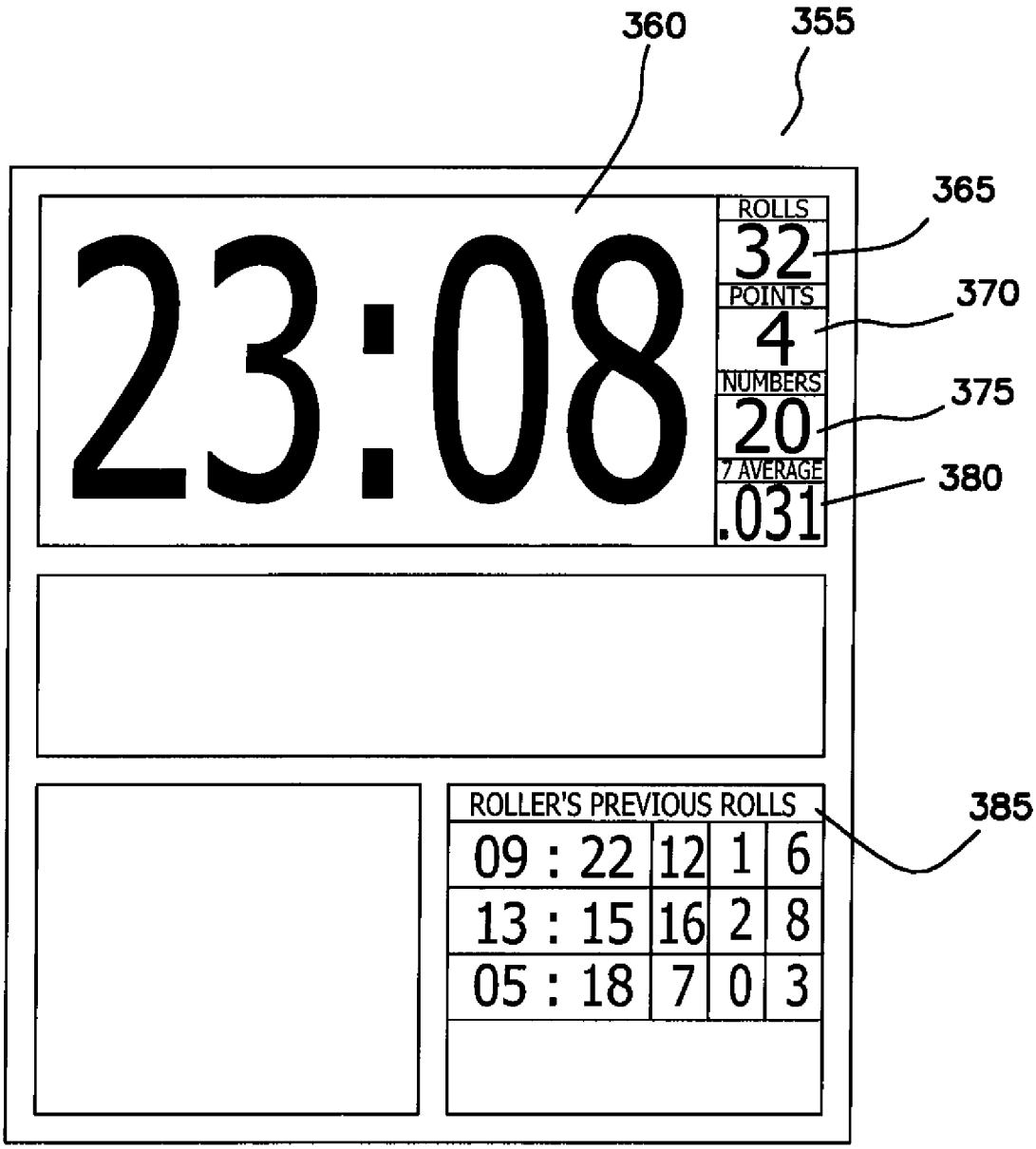
FIG. 6 illustrates a fifth exemplary craps display screen.
Figure 7:
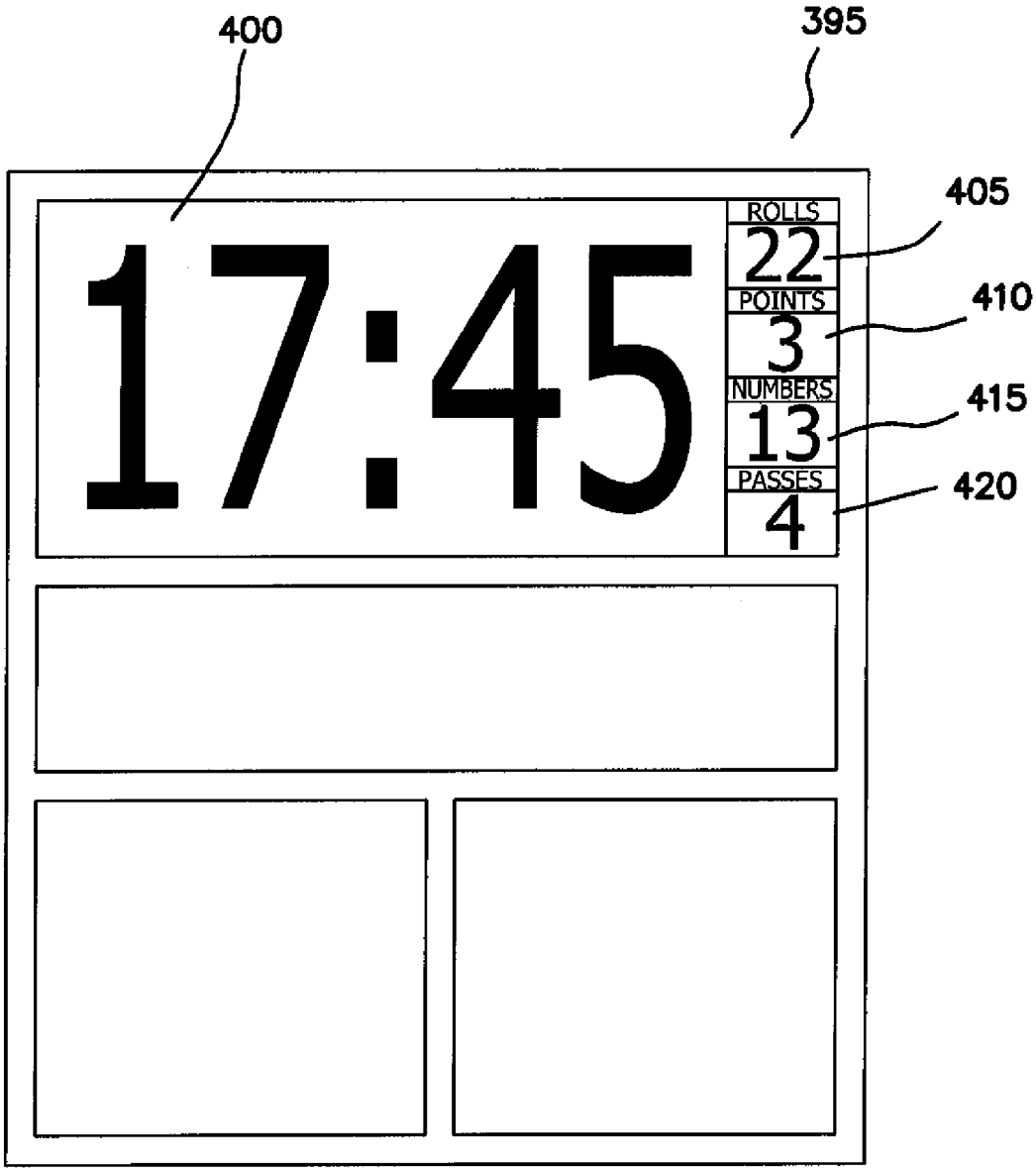
FIG. 7 illustrates a sixth exemplary craps display screen.

FIG. 5 shows another display screen 315 having sections corresponding to a clock 320, number of rolls 325, points made 330, numbers rolled 335, chart of numbers rolled 340, and an overhead or birds-eye view of a simulated craps table 345. A series of times 350 corresponding to the time each shooter, at each player position around the craps table, held the dice. FIG. 6 shows another display screen 355 having sections corresponding to a clock 360, number of rolls 365, points 370, numbers rolled 375, average 380 and prior roll history 385 of the current shooter. The average corresponds to the average times the shooter rolls a 7 after a point has been established. In this instance, the shooter rolls a 7 thirteen percent of the time or less than once every six rolls, after establishing a point. Players take pride in being able to control the dice including the ability to not roll 7s on non-come out rolls. FIG. 7 shows a display screen 395 having sections corresponding to a clock 400, number of rolls 405, points 410 and passes 415. Passes can be made on points as well as 7s and 11s rolled on the come out roll. 7s and 11s on the come out roll are winning outcomes for pass line bettors. The number of passes is useful because most players play the pass line and therefore profit from such outcomes.

Those skilled in the art will recognize that an infinite number of sectioned display screens can be created and that those shown in FIGS. 2-7 are exemplary only. Also, the displays may be used to present any conceivable craps game data desired.

For the purposes of storing certain craps game data, such as records or a shooter's history of rolls, the display communicates with a storage device (e.g., RAM memory) that maintains craps game data and makes it available to the display as desired. For advanced display options, a processor or similar electronic device may be integrated in the display.

Figure 8:
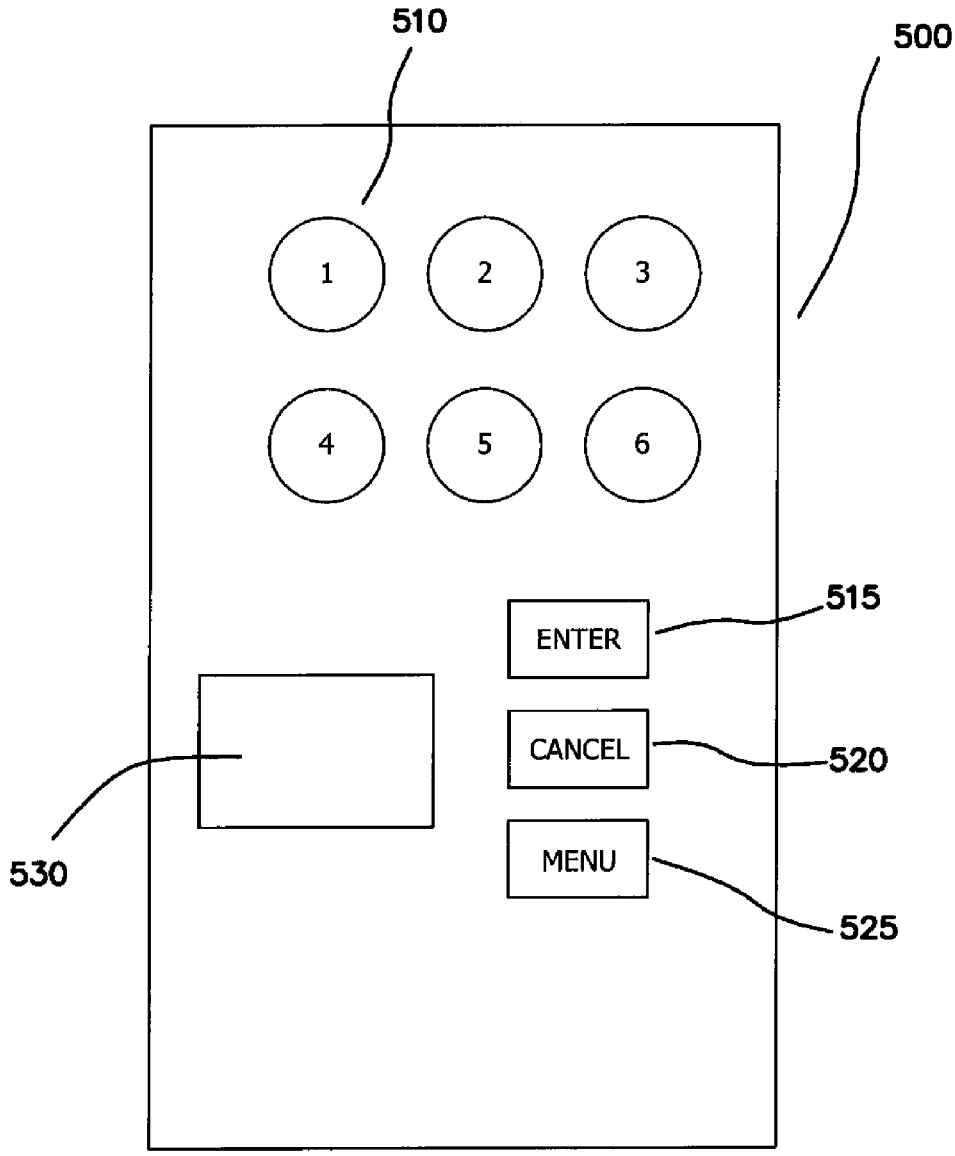
FIG. 8 illustrates a manual keypad for casino personnel to enter craps game data.

FIG. 8 shows an exemplary controller 500 operable to allow craps table personnel to operate the content of a display screen. The controller 500 is ideally a hand-held wireless remote control device but the controller 500 may also be in wired communication with the display. A wireless remote control device should have a built-in relationship (e.g., keys) with a corresponding display because many craps tables and corresponding displays may be arranged in close proximity to one another. The controller 500 includes a keypad 505 having "number" keys 510 numbered 1-6 representing the possible values for each rolled die, an "enter" key 515, a "cancel" key 520 and "menu" key 525. A display 530 incorporated on said controller 500 allows a user to scroll through menu options. The number keys 510 also incorporate various letters to allow for text (e.g., shooter's name) to be entered. Upon opening a new craps table, casino personnel may either turn on the display or shift from a non-gaming mode to a gaming mode using the menu key 525. The non-gaming mode may comprise displaying advertisements, sporting events or other information unrelated to a craps game. Once turned on or otherwise accessed, casino personnel may have the option, via the menu key 525 to select any number of display screens, such as those set forth in FIGS. 2-7 or others. Display screens may be changed during a craps session as desired by casino personnel. Alternatively, the casino may elect to store only one display screen for their routine use. Once the proper display screen has been selected, and a shooter has rolled the dice, the casino personnel enter the outcome of the roll, one die at a time, using the numbered keys 510 and enter key 515. Any errors may be overridden by the cancel key 520. The entry of the roll outcome also triggers the clock to start. Alternatively, a clock start key (not shown) may be integrated on the controller 500. Once the player sevens-out (i.e., rolls a seven after a made point), the clock automatically ceases when one of the casino personnel enter the seven outcome or alternatively one of the casino personnel depress a clock stop key (not shown). To signify the end of the current shooter's roll, the displayed clock may flash before being re-set to zero or until the next shooter's first roll of the dice. A pause key may be used to stop the clock when desired. For example, if one or both die leave the table, a table audit is being conducted or a player is purposefully taking too long between rolls. The menu key 525 may provide access to any suitable display functions and the controller 500 may include any desired keys related to display control.

Figure 9:
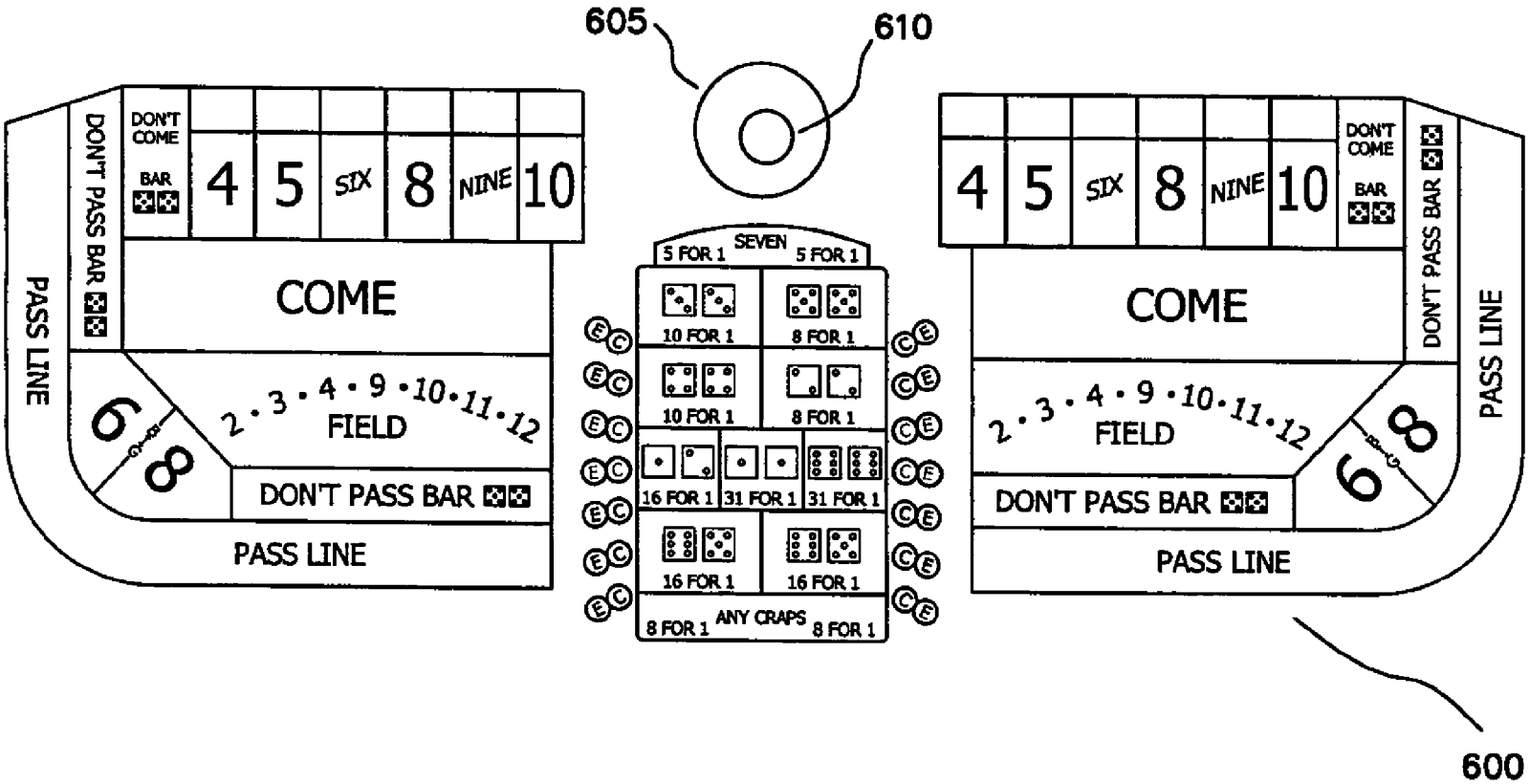
FIG. 9 illustrates a craps table with an integrated dice scanner/camera.

In another embodiment, the outcomes of the dice are scanned and automatically communicated to the display. FIG. 9 shows a craps table 600 including a transparent glass or plastic covering 605 under which an optical scanner 610, digital camera or similar image capturing device is able to read the outcomes of the rolls of the dice. Multiple scanners, cameras or similar devices may be integrated into a single craps table as well. With such an embodiment, after a roll of the dice, one of the casino personnel (e.g., dealer) operating the craps game, moves the dice over the transparent glass or plastic coverings 605 such that the scanner 610 is able to read the bottom of the dice. In other words, the outcome of the roll of the dice is not disturbed. Using the scanned indicia from the bottom of the dice, a processor or similar device determines the outcome of the dice roll. For example, if the bottom of each die comprises a 2 and a 3, the outcome of the roll of the dice is 9 based on summing the 5 and 4 opposite the 2 and 3, respectively. Once the outcome is determined, it is automatically transmitted to the display. The transmission may be made between the processor that is in communication with the scanner or camera via a wired or wireless connection with the display. The scanner 610 or camera may also be positioned above the craps table to directly capture the outcomes of each dice roll. Such an arrangement may consist of hanging the devices from an overhead support or attaching them to the craps table in a unobtrusive location.

Figure 10C:
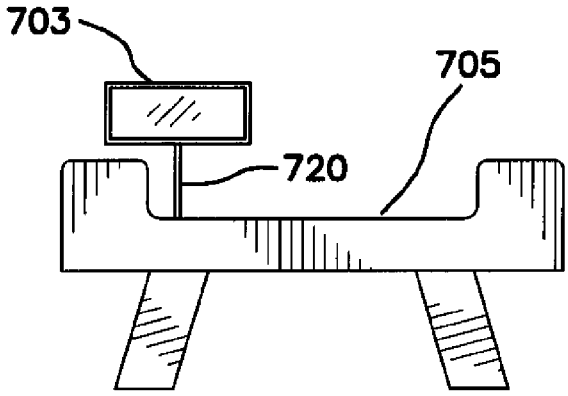
Figure 10D:
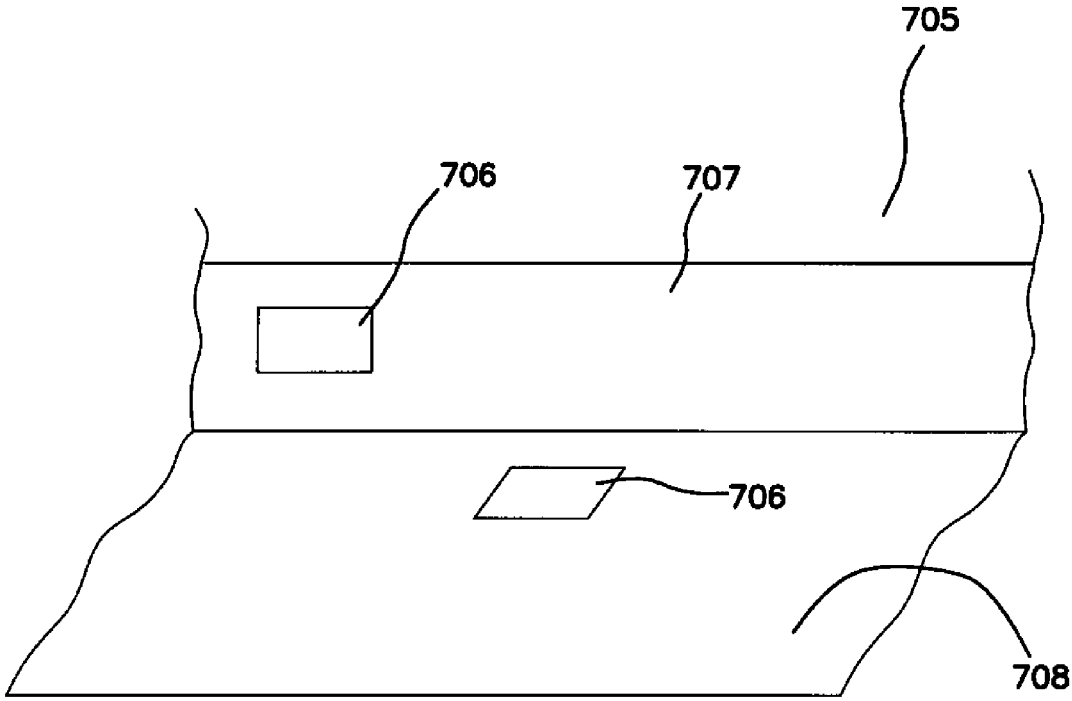

FIGS. 10*a*, 10*b* and 10*c* show a display 700-702 in proximity to a craps table 705. In FIG. 10*a*, the display 700 is hanging over the craps table 705. In FIG. 10*b*, the display 701 is supported by a rigid pole 710 and stand 715 positioned adjacent to the craps table 705. In FIG. 10*c*, the display 702 is attached or engaged to the craps table 705 by means of pole 720. FIG. 10*d* shows a display 706 integrated into a wall 707 and a surface 708 of the craps table 705.

In yet another embodiment, a printer (not shown) is connected to the display system, namely the memory. The printer is used to print a shooter's roll history. A printout may include a player's name, casino name, date and time, game data and the like. The printout provides the player with tangible evidence of his or her tremendous or lackluster rolls.

Linking the display system to the casino's player tracking system also allows the casino, by swiping the player's card through a local card reader, to display the shooter's name and/or print it on the aforementioned printout without casino personnel having to spend time extracting the information from the player. If the player does not have a player's card, casino personnel may ask the player to volunteer his or her name or request that he sign up for a player's card.

Although the invention has been described in detail with reference to several embodiments, additional variations and modifications exist within the scope and spirit of the invention as described and defined in the following claims.

I claim:

1. A craps system comprising:

a display configured to display craps game data including a clock recording each player's roll time;

memory means configured to store historical craps game data;

means for personnel overseeing a live craps game to input current craps game data and access historical craps game data;

transmission means for transmitting said input craps game data to said display for display, wherein said craps game data includes historical and current craps game data associated with a current dice roller; and wherein said clock is started automatically after an input of a first roll outcome for a player and stopped automatically after an input of a seven roll outcome for said player subsequent to the first roll outcome.

2. The system of claim 1 wherein said means for personnel overseeing a live craps game to input craps game data is a hand-held wireless or wired remote control device.

3. The system of claim 1 wherein said transmission means comprises a cable, or wireless radio or infrared signal.

4. The system of claim 1 further comprising receiving means integrated into said display, said receiving means for receiving said transmitted game data.

5. The system of claim 1 further comprising a printer operable to generate a printout comprising craps game data.

6. The system of claim 1 wherein the display is positioned above, adjacent to, or within a corresponding craps table.

7. The system of claim 1 wherein the system communicates with a player tracking system.

8. The system of claim 1 further comprising memory means operable to store craps game data.

9. A craps system comprising:

a display configured to display craps game data including a clock recording each player's roll time;

a remote control device for personnel overseeing a live craps game to input craps game data;

a transmitter for transmitting input game data to a receiver integrated into said display, said receiver receiving said transmitted game data such that said data is displayed, wherein said craps game data includes historical and current craps game data associated with a current dice roller; and wherein said clock is started automatically after an input of a first roll outcome for a player and stopped automatically after an input of a seven roll outcome for said player subsequent to the first roll outcome.

10. The system of claim 9 wherein the transmitter transmits a signal via a cable.

11. The system of claim 9 wherein the transmitter sends a wireless radio or infrared signal.

12. The system of claim 9 further comprising a printer operable to generate a printout comprising craps game data.

13. The system of claim 9 wherein the system communicates with a player tracking system.

14. The system of claim 9 further comprising memory means operable to store craps game data.

15. A craps system comprising:

a display configured to display craps game data including a clock recording each player's roll time;

means for automatically acquiring craps game data;

transmission means for transmitting said acquired game data to said display for display, wherein said craps game data includes historical and current craps game data associated with a current dice roller; and wherein said clock is started automatically after acquisition of a first roll outcome for a player and stopped automatically after acquisition of a seven roll outcome for said player subsequent to the first roll outcome.

16. The system of claim 15 wherein said means for automatically acquiring craps game data comprises an optical scanner or digital camera.

17. The system of claim 15 wherein said means for automatically acquiring craps game data is integrated into a craps table.

18. The system of claim 15 wherein said transmission means transmits a radio or infrared signal.

19. The system of claim 15 further comprising receiving means integrated into said display, said receiving means for receiving said transmitted game data.

20. The system of claim 15 further comprising a printer operable to generate a printout comprising craps game data.

21. The system of claim 15 further comprising memory means operable to store craps game data.

22. A craps system comprising:

a display configured to display craps game data including a clock recording each player's roll time;

one or more optical scanners or cameras in communication with said display and operable to read die;

wherein a roll outcome, generated from outputs of the one or more optical scanners or cameras, is transmitted to said display for display, wherein said craps game data includes historical and current craps game data associated with a current dice roller; and wherein said clock is started automatically after reading of a first roll outcome for a player and stopped automatically after reading of a seven roll outcome for said player subsequent to the first roll outcome.

23. The system of claim 22 wherein said one or more optical scanners or cameras are integrated into a craps table.

24. The system of claim 22 wherein the roll outcomes are transmitted as radio or infrared signals.

25. The system of claim 24 further comprising receiving means integrated into said display, said receiving means for receiving said transmitted roll outcomes.

26. The system of claim 22 further comprising a printer operable to generate a printout comprising craps game data.

27. The system of claim 22 further comprising memory means operable to store craps game data.

28. An electronically implemented method comprising:

inputting craps game data via a display interface in the form of a controller;

transmitting via wired or wireless connection said input game data to a display from said controller; and utilizing said transmitted game data to generate a display output on said display including a clock recording each player's roll time, wherein said craps game data includes historical and current craps game data associated with a current dice roller; and wherein said clock is started automatically after input of a first roll outcome for a player and stopped automatically after input of a seven roll outcome for said player subsequent to the first roll outcome.

29. The method of claim 28 further comprising displaying at least one of the following craps game data:

a) prior roll outcomes;

b) simulation of current dice roll;

c) best recorded rolls;

d) times for each player position about a craps table;

e) player's percentage of rolling a seven after a point is established;

f) player's passes; or g) player's roll history.

30. The method of claim 28 further comprising acquiring information from a player tracking system.

31. The method of claim 28 further comprising utilizing memory to store craps game data.

32. An electronically implemented method comprising:

acquiring automatically craps game data using electronic scanning means;

transmitting via wired or wireless connection said acquired game data to a display from said scanning means;

utilizing said transmitted game data to generate a display output on said display including a clock recording each player's roll time, wherein said craps game data includes historical and current craps game data associated with a current dice roller and wherein said clock is started automatically after acquiring a first roll outcome for a player and stopped automatically after acquiring a seven roll outcome for said player subsequent to the first roll outcome.

33. The method of claim 32 further comprising utilizing one or more optical scanners or cameras to acquire automatically craps game data.

34. The method of claim 32 further comprising causing the clock to flash after a player sevens out.

35. The method of claim 32 further comprising displaying at least one of the following craps game data:

a) prior roll outcomes;

b) simulation of current dice roll;

c) best recorded rolls by day, week, month, year or all time;

d) times for each player position about a craps table;

e) player's seven average;

f) player's passes; or g) player's roll history.

36. The method of claim 32 further comprising acquiring information from a player tracking system.

37. The method of claim 32 further comprising utilizing memory to store craps game data.

38. A craps table comprising:

one or more legs;

a wall circumscribing a playing surface, said playing surface supporting a craps game layout;

means for automatically acquiring craps game data integrated into said playing surface;

a display communicatively linked to said means for automatically acquiring craps game data, said display configured to display said craps game data including a clock recording each player's roll time, wherein said craps game data includes historical and current craps game data associated with a current dice roller; and wherein said clock is started automatically after acquiring a first roll outcome for a player and stopped automatically after acquiring a seven roll outcome for said player subsequent to the first roll outcome.

39. The craps table of claim 38 wherein said means for automatically acquiring craps game data comprises an optical scanner or digital camera.

40. The craps table of claim 38 further comprising a display integrated into the craps table.

41. The craps table of claim 40 wherein the display is integrated into a wall or the surface of the craps table.

* * * * *